US007445823B2

(12) United States Patent
Tennison

(10) Patent No.: US 7,445,823 B2
(45) Date of Patent: Nov. 4, 2008

(54) ARTIFICIAL TREE

(76) Inventor: Lora L. Tennison, 720 Bluebonnet Dr., Allen, TX (US) 75002

( * ) Notice: Subject to any disclaimer, the term of this patent is extended or adjusted under 35 U.S.C. 154(b) by 175 days.

(21) Appl. No.: 11/503,582

(22) Filed: Aug. 14, 2006

(65) Prior Publication Data

US 2008/0038490 A1 Feb. 14, 2008

(51) Int. Cl.
*A47G 33/06* (2006.01)

(52) U.S. Cl. ..... 428/20; 428/18; 362/123; 362/567; 362/568; 362/806

(58) Field of Classification Search ..... 428/18, 428/19, 20; 362/122, 123, 567, 568, 806
See application file for complete search history.

(56) References Cited

U.S. PATENT DOCUMENTS 1,654,427 A * 12/1927 Modlarz ..... 211/196
3,595,209 A 7/1971 Parker
4,142,012 A * 2/1979 Clamage ..... 428/8
4,654,991 A 4/1987 Jones
4,749,088 A 6/1988 Workman et al.
4,855,880 A * 8/1989 Mancusi Jr. ..... 362/123
4,903,846 A 2/1990 Smith
5,455,750 A * 10/1995 Davis et al. ..... 362/123
6,648,283 B2 11/2003 Chase et al.
7,163,725 B2 * 1/2007 Johnson et al. ..... 428/20
7,232,596 B2 * 6/2007 Lai ..... 428/18

* cited by examiner

*Primary Examiner*—John J. Zimmerman
*Assistant Examiner*—Aaron Austin
(74) *Attorney, Agent, or Firm*—Dale J. Ream

(57) ABSTRACT

An artificial tree according to the present invention includes a tubular trunk with a stand for holding the trunk in an upright position. The artificial tree includes a plurality of branches coupled to the tree, each branch having a hook at an end displaced from the trunk. Each branch presents a length with branches at lower trunk levels having longer lengths than more upwardly positioned branches. The branches may be removably coupled to the trunk and storable within a trunk interior space. The artificial tree may also include ornamentation such as garland or lights and may include an audio device that plays sound in predetermined conditions.

17 Claims, 7 Drawing Sheets

ARTIFICIAL TREE

BACKGROUND OF THE INVENTION

This invention relates generally to an artificial ornamental tree and, more particularly to an artificial tree for hanging festive holiday stockings and that is adjustable and collapsible.

Hanging stockings at festive occasions, such as Christmas, has become very popular. Stockings are typically very colorful and come in a variety of sizes for holding several small gifts or candy. In the past, it was traditional to hang stockings on a fireplace mantle. However, this is not always feasible and so stockings must sometimes be hung from hooks or other hardware inserted into walls or door frames.

Various devices have been proposed in the art for hanging stockings or other ornamental items. Although assumably effective for their intended purposes, traditional hanging devices do not have the construction of an artificial tree that is adjustable, collapsible, and perfectly suitable to hang festive stocking or the like.

Therefore, it would be desirable to have an artificial tree that includes a plurality of branches with hooks for securing respective stockings. Further, it would be desirable to have an artificial tree with a collapsible design that is fast to assemble for use or to disassemble for storage. In addition, it would be desirable that all components of the artificial tree may be stored within the trunk for storage. Various lighting options would also be desirable so that the artificial tree is an attractive addition to holiday events.

SUMMARY OF THE INVENTION

Accordingly, an artificial tree for securing a plurality of festive stockings according to the present invention includes a tubular trunk with a stand to hold it in an upright position and a plurality of branches. Each branch has a hook at an end that may be positioned away from the trunk when the opposed end is adjacent to the trunk. The branches may be of different lengths so that the lower branches may be longer than upper ones. The trunk may have a plurality of openings complementary to the structure of respective branch ends for removably coupling the branches to the trunk. In this embodiment, the branches may be removed and stored in the trunk. In another embodiment, the branches are hingedly attached and, when folded upwardly, may be stored in a storage bag. This invention may include ornamentation supported by a plurality of the hooks, such as a string of lights or garland. An audio device may also be included.

Therefore, a general object of this invention is to provide an artificial tree for securing a plurality of festive stockings.

Another object of this invention is to provide an artificial tree, as aforesaid, that is collapsible for storage.

Still another object of this invention is to provide an artificial tree, as aforesaid, having a plurality of branches, each with a hook on its distal end.

Yet another object of this invention is to provide an artificial tree, as aforesaid, in which each upward row of branches includes shorter length branches than the row below.

A further object of this invention is to provide an artificial tree, as aforesaid, in which the branches may be stored in the tree trunk.

A still further object of this invention is to provide an artificial tree, as aforesaid, having ornamentation or audio features.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
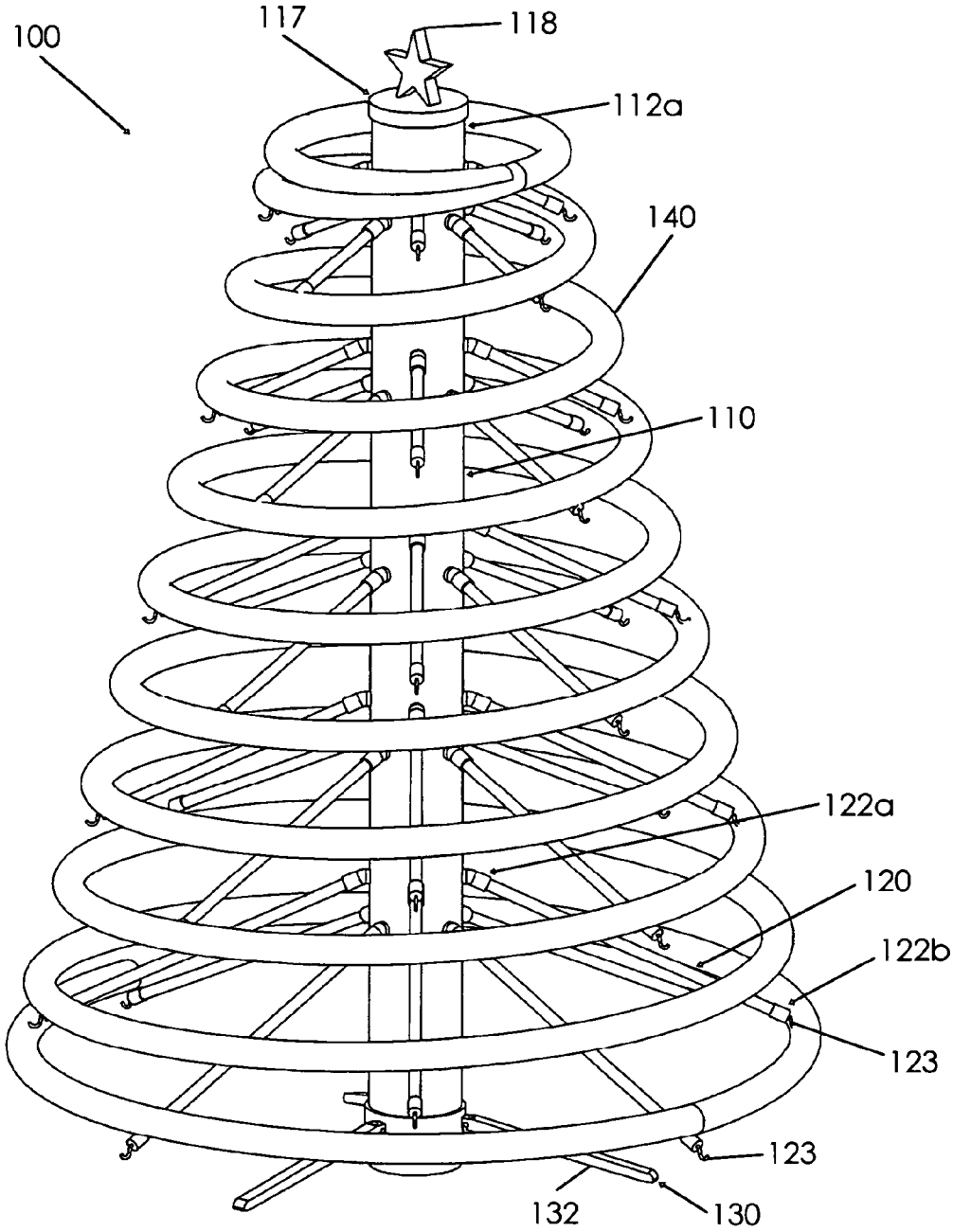
FIG. 1 is a perspective view of an artificial tree according to one embodiment of the present invention.
Figure 2:
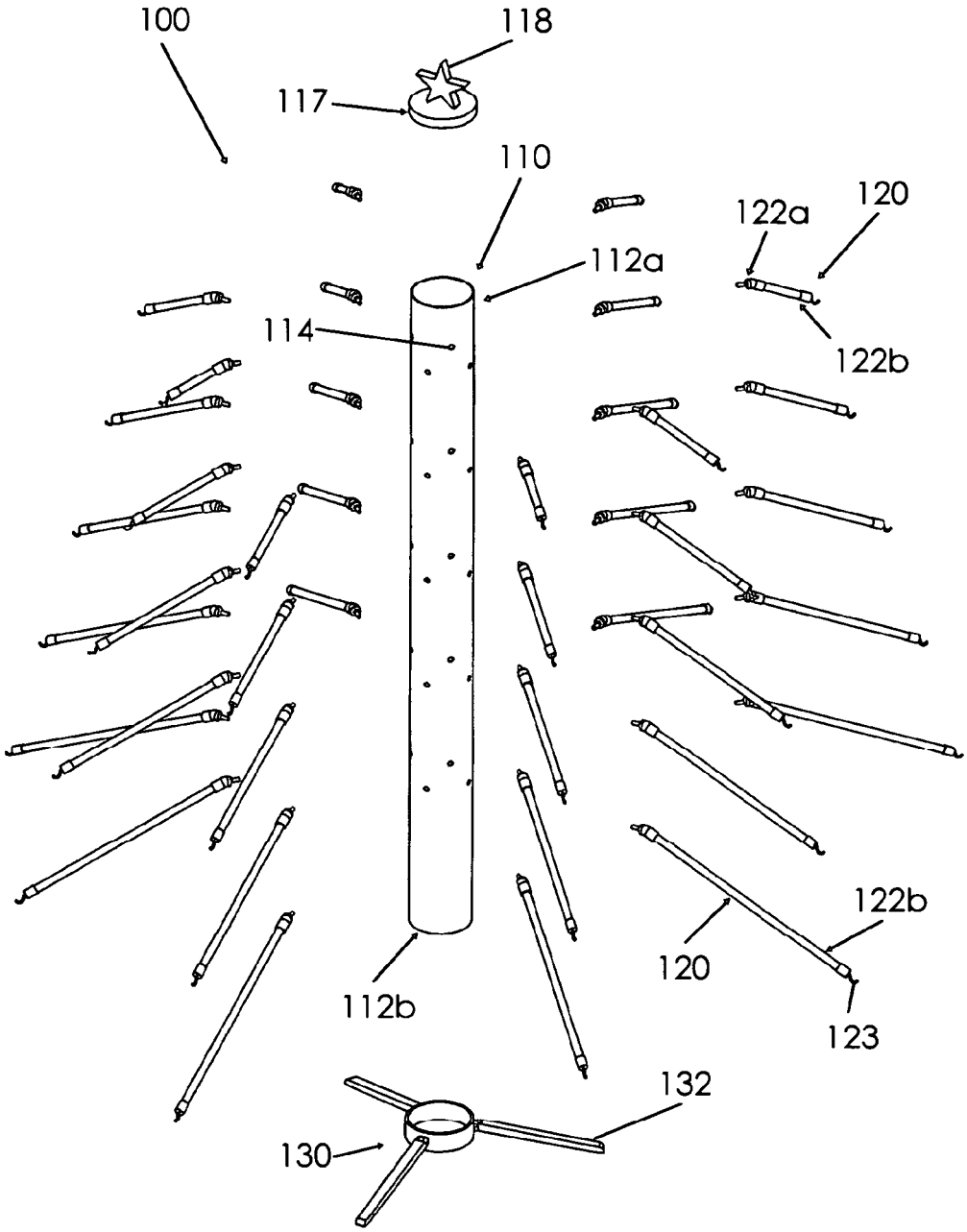
FIG. 2 is an exploded view of the artificial tree as in FIG. 1 with the ornamentation removed.
Figure 3A:
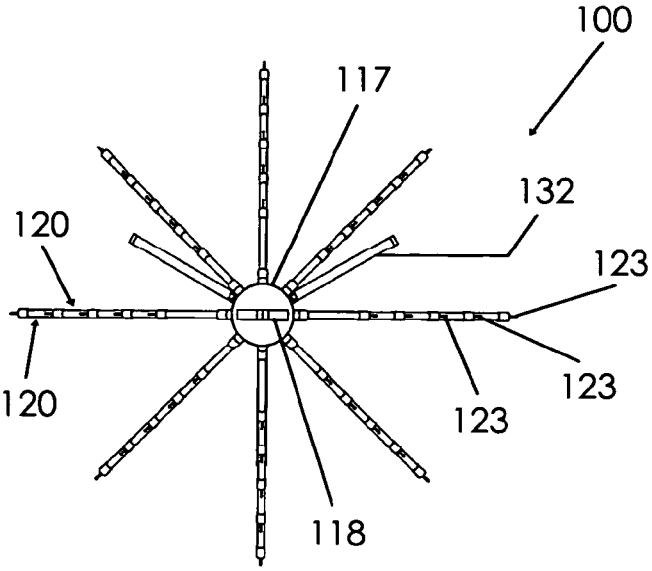
FIG. 3*a* is a top view of the artificial tree as in FIG. 1 with the ornamentation removed.
Figure 3B:
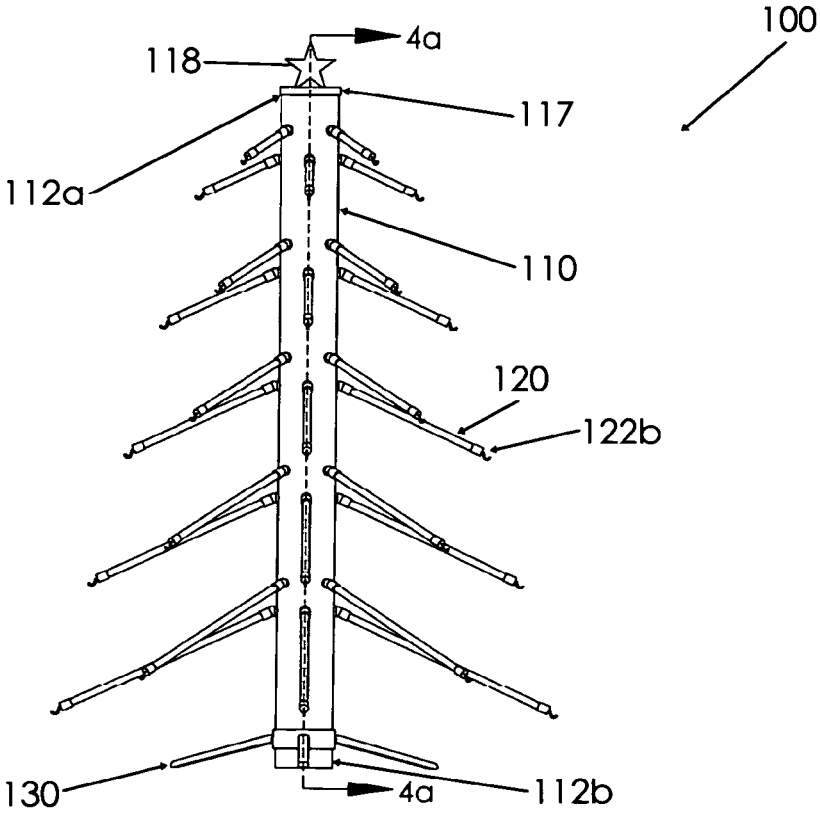
FIG. 3*b* is a side view of the artificial tree.

An artificial tree 100 according to the present invention will now be described in detail with reference to FIGS. 1 through 4*b* and 6*a* through 7*b* of the accompanying drawings. More particularly, an artificial tree 100 according to the current invention includes an elongate trunk 110 and a plurality of branches 120.

The trunk 110 presents upper and lower ends 112*a*, 112*b*, may be tubular (FIG. 4*b*), and may be constructed of plastic, metal, or another suitable material. Each branch 120 has opposed first and second ends 122*a*, 122*b*, and each second end 122*b* has a hook 123 and is positionable away from the trunk 110 when the opposed first end 122*a* is adjacent the trunk 110. Each branch 120 has a branch length, and as shown in FIG. 1 through FIG. 5*c*, the branch length may increase with relative placement of the respective first ends 122*a* along the trunk 110 so that branches 120 with greater branch lengths are closer to the trunk lower end 112*b* than are branches 120 with lesser branch lengths. In other words, every branch 120 having a respective first end 122*a* relatively closer to the trunk lower end 112*b* may have a branch length that is at least as long as every other branch 120 having a respective first end 122*a* relatively closer to the trunk upper end 112*a*. As shown in FIGS. 6*a* and 6*b*, however, each branch 120 may have a branch length that is substantially equal to a branch length of every other said branch 120. In other words, all of the branches 120 may be of substantially the same length.

Means for supporting the trunk 110 in an upright position are included. More particularly, a stand 130 adjacent the trunk lower end 112*b* may support the trunk 110 in an upright position. The stand 130 may present a diameter that is larger than a diameter of the trunk 110 to support the trunk 110, and the diameter may be defined by a continuous or semi-continuous rim (not shown) or by a plurality of legs 132. According to one embodiment, the legs 132 are foldable and the stand 130 is selectively slidable along the trunk 110 or removable from the trunk 110 for storage purposes (FIG. 5*b*).

Ornamentation 140 may be included to be supported by a plurality of the hooks 123 t the second ends 122*b* of the branches 120 so that the ornamentation 140 encircles the trunk 110 as shown in FIG. 1. The ornamentation 140 may be, for example, a garland or a lighting device (e.g., a strand or rope of lights or another device that produces or transmits light).

Figure 7A:
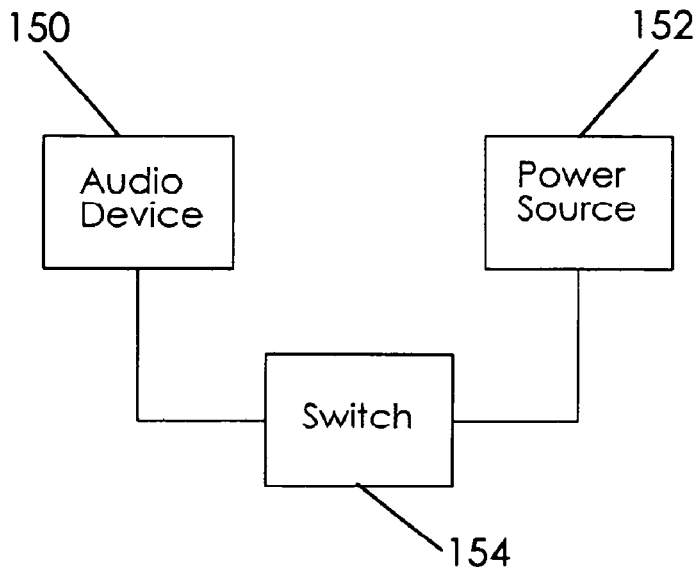
FIG. 7*a* is a block diagram of an audio device for the artificial tree according to the present invention.
Figure 7B:
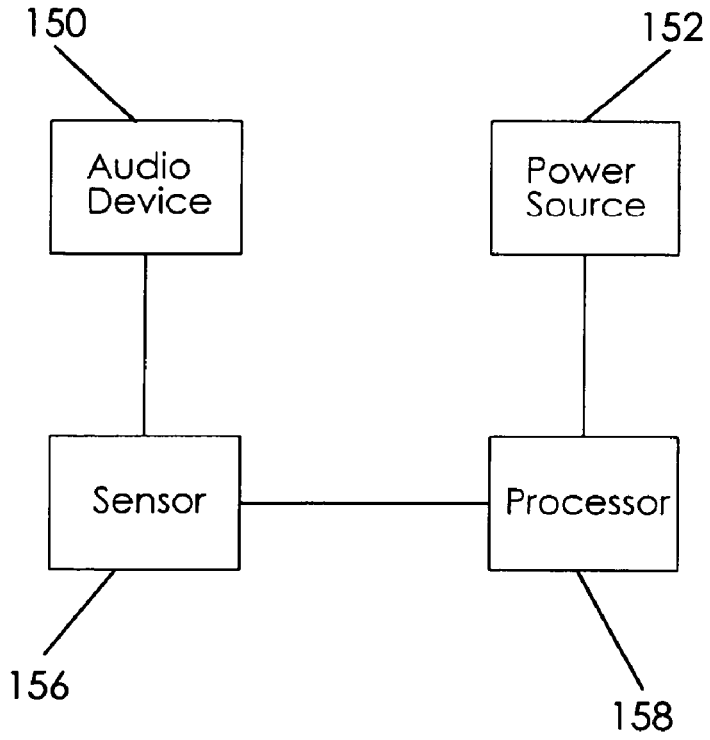
FIG. 7*b* is a block diagram of an audio device and sensor for the artificial tree according to the present invention.

An audio device 150 may be in communication with a power source 152 and means for actuating the audio device 150 for selectively providing sound. As shown in FIG. 7*a*, the means for actuating the audio device 150 may include a switch 154. As shown in FIG. 7*b*, the means for actuating the audio device 150 may include a sensor 156 and a processor 158 for selectively providing sound when the sensor 156 detects a predetermined condition. The sensor 156, for example, may be a pressure sensor located in or adjacent a branch 120, and the predetermined condition may be a change in pressure on the branch 120. This would cause the audio device 150 to provide sound when an article is placed on (or taken away from) the branch 120. Alternately, the sensor 156 may be a motion sensor, for example, and the predetermined condition may be motion in a predetermined area. This would cause the audio device 150 to provide sound when motion is detected (e.g., when the artificial tree 100 is approached).

Figure 4B:
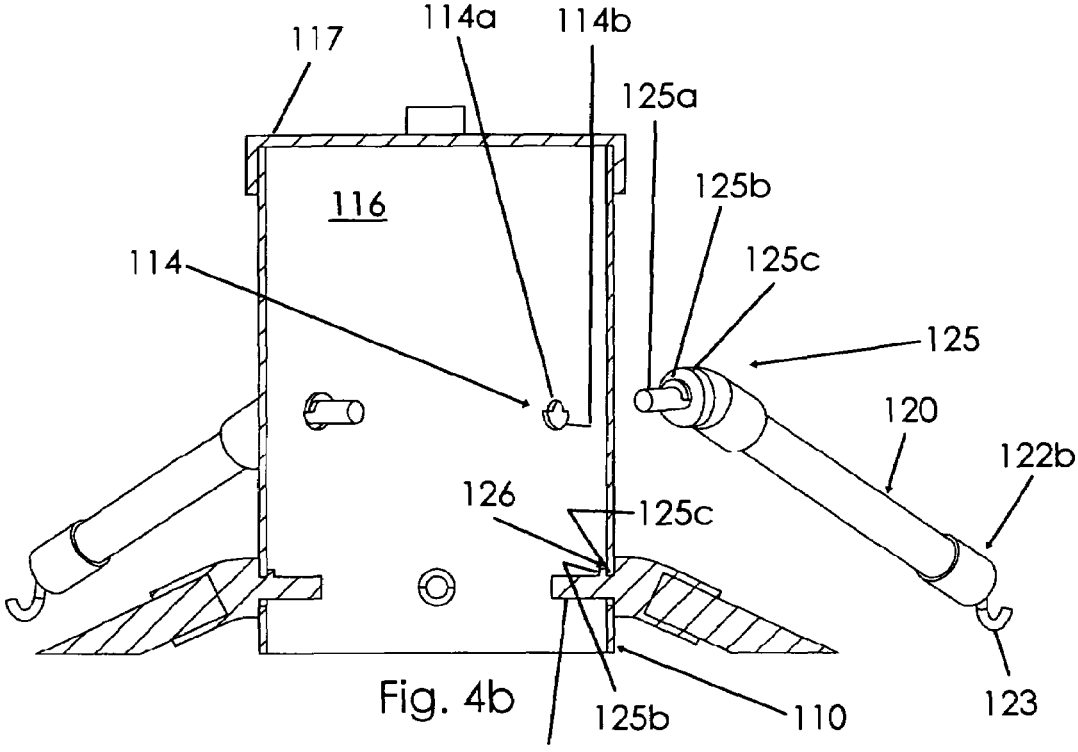
FIG. 4*b* is an isolated view taken on an enlarged scale taken from FIG. 4*a;*
Figure 4A:
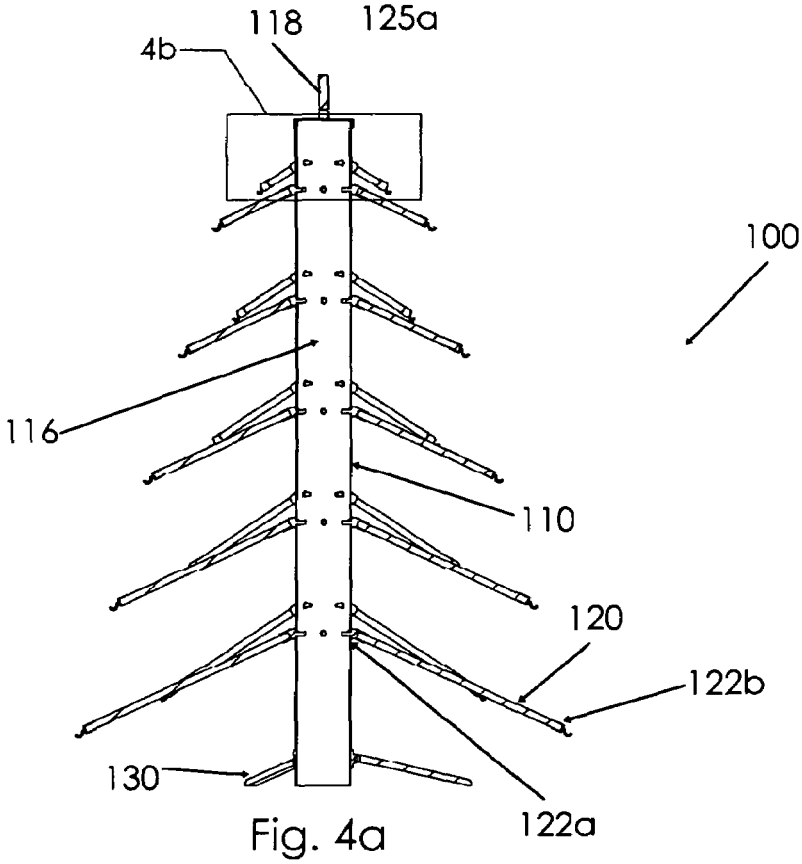
FIG. 4*a* is a sectional view of the artificial tree taken along line 4*a*-4*a* of FIG. 3*b;*

As shown in FIG. 2 through FIG. 4*b*, the trunk 110 may define a plurality of openings 114 between the trunk upper and lower ends 112*a*, 112*b*, and each branch first end 122*a* may have an extension 125 complementary to a respective trunk opening 114 for selectively coupling the branch first end 122*a* to the trunk 110. Each trunk opening 114 may include a primary opening 114*a* and a flange opening 114*b*, as best shown in FIG. 4*b*. Each extension 125 may include a primary member 125*a*, a flange 125*b*, and a plate 125*c* (FIG. 4*b*). The flange 125*b* and the plate 125*c* may both have diameters that are larger than a diameter of the primary member 125*a*, and the plate 125*c* may be spaced apart from the flange 125*b* to define a receiving area 126 therebetween. Each primary member 125*a* may be receivable in a respective primary opening 114*a*, each flange 125*b* may be receivable in a respective flange opening 114*b*, and each extension 125 may be rotatable to sandwich the trunk 110 between its flange 125*b* and its plate 125*c* (FIG. 4*b*) when its primary member 125*a* is received in a respective primary opening 114*a* and its flange 125*b* is received in a respective flange opening 114*b*. By sandwiching the trunk 110 between the flange 125*b* and the plate 125*c*, the extension 125 (and therefore the branch 120) is coupled to the trunk 110. The trunk 110 may define an interior cavity 116 that extends to the trunk upper end 112*a* and has a diameter sufficient to house the branches 120 when the first ends 122*a* of the branches 120 are not coupled to the trunk 110. This provides a convenient way to store the artificial tree 100 when it is not in use. A cap 117 may be selectively coupled to the trunk 110 at the trunk upper end 112*a* to selectively restrict access to the trunk interior cavity 116, and a decorative element 118 may extend upwardly from the cap 117.

In use, the trunk 110 may be supported in an upright position by the stand 130. The branches 120 may then be coupled to the trunk 110 by interactions between the extensions 125 and the trunk 110 at the trunk openings 114 as described above. The ornamentation 140 may be supported by a plurality of the hooks 123 at the second ends 122*b* of the branches 120 so that the ornamentation 140 encircles the trunk 110, and other objects (e.g., stockings, ornaments, etc.) may be attached to the artificial tree 100 at the hooks 123. If included, the audio device 150 may be used as described above. To store the artificial tree 100, the ornamentation 140 and all other objects may be removed from the hooks 123, and the branches 120 may be uncoupled from the trunk 110 in a manner opposite of how they were attached. The cap 117 may be removed from the trunk upper end 112*a*, and the branches 120 may be stored in the trunk interior cavity 116. The stand 130 may be removed from the trunk 110 or folded as described above.

Figure 5A:
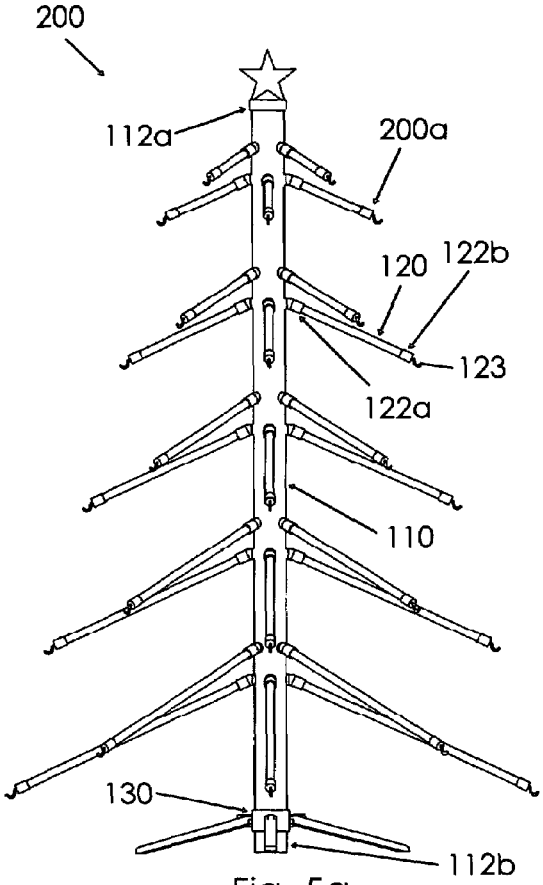
FIG. 5*a* is a perspective view of an artificial tree according to another embodiment of this invention in an extended configuration.
Figure 5B:
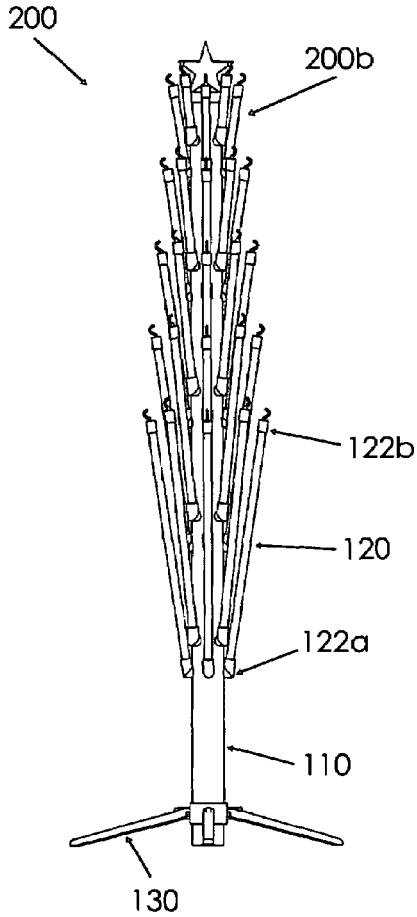
FIG. 5*b* is a perspective view of the artificial tree as in FIG. 5*a* in a collapsed configuration.
Figure 5C:
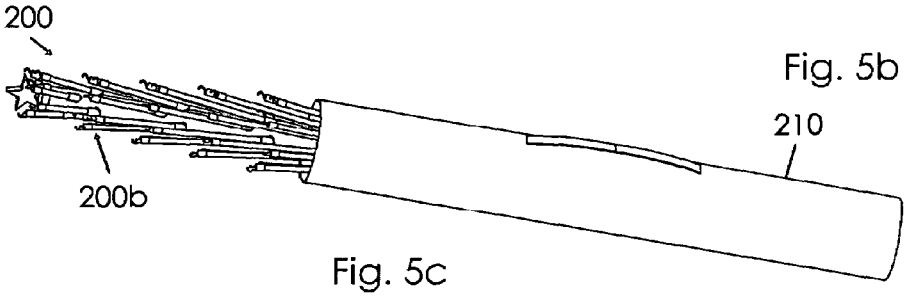
FIG. 5*c* is a perspective view of the artificial tree as in FIG. 5*b* partially inserted into a case.
Figure 6A:
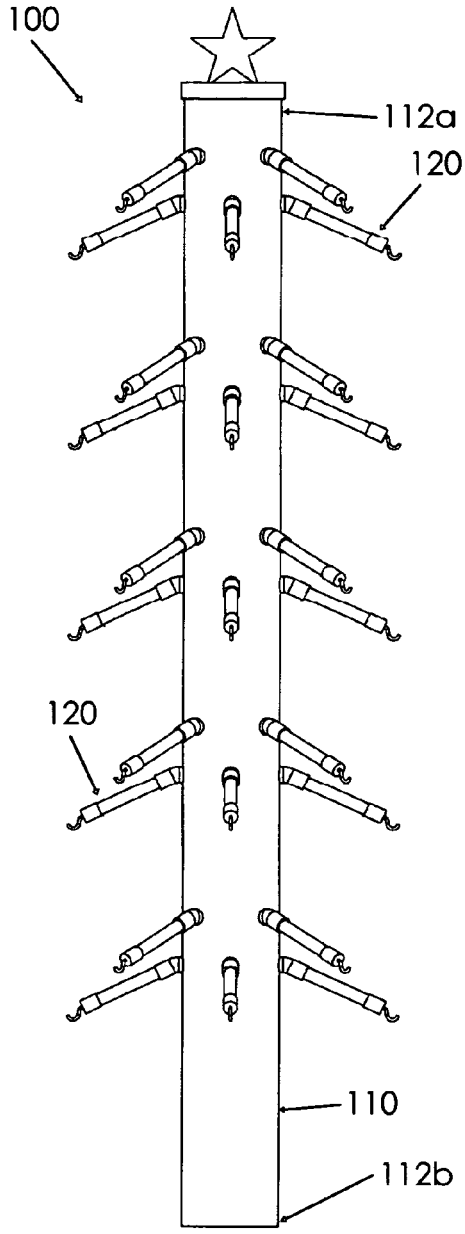
FIG. 6*a* is a side view of an artificial tree according to yet another embodiment of this invention showing all branches with an equal length.
Figure 6B:
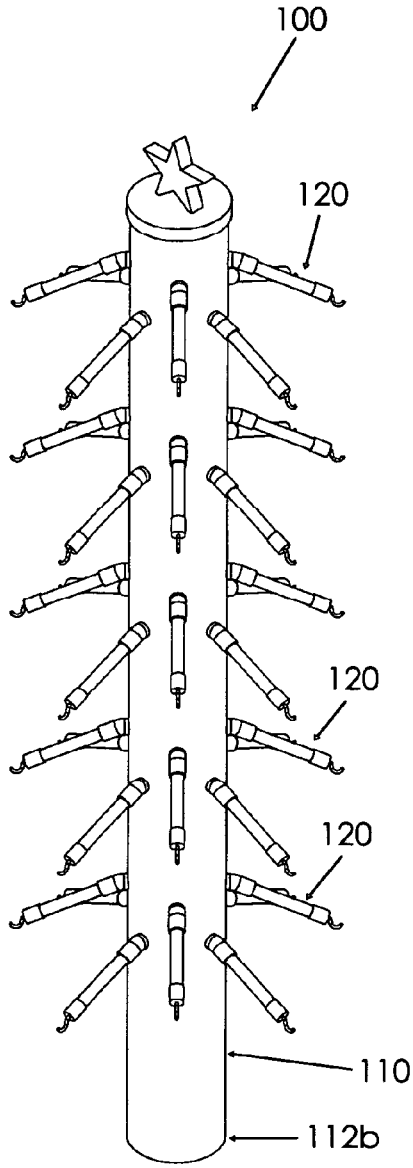
FIG. 6*b* is a perspective view of the artificial tree as in FIG. 6*a;*

An artificial tree 200 according to another embodiment of the present invention is shown in FIG. 5*a* through FIG. 5*c* and includes a construction substantially similar to the construction previously described except as specifically noted below. More particularly, each branch first end 122*a* may be hingedly coupled to the trunk 110 between the trunk upper and lower ends 112*a*, 112*b* so that the respective branch second end 122*b* can rotate from a first position 200*a* (FIG. 5*a*) to a second position 200*b* (FIG. 5*b*). The second ends 122*b* are relatively closer to the trunk upper end 112*a* when at the second position 200*b* than when at the first position 200*a*, and the artificial tree 200 takes up less space and may be more easily stored when the second ends 122*b* are at the second position 200*b*. A storage case 210 may be included for housing the trunk 110 and the branches 120 when the branch second ends 122*b* are at the second position 200*b*, as shown in FIG. 5*c*.

In use, the trunk 110 may be supported in an upright position by the stand 130. When the trunk 110 is turned upright, the second ends 122*b* of the branches 120 may rotate from the second position 200*b* to the first position 200*a* (as described above) due to gravity or with a user's assistance. The ornamentation 140 may be supported by a plurality of the hooks 123 at the second ends 122*b* of the branches 120 so that the ornamentation 140 encircles the trunk 110, and other objects (e.g., stockings, ornaments, etc.) may be attached to the artificial tree 200 at the hooks 123. If included, the audio device 150 may be used as described above. To store the artificial tree 200, the ornamentation 140 and all other objects may be removed from the hooks 123, and the trunk 110 may be turned from the upright position to an upside-down position. By rotating the trunk 110, the second ends 122*b* of the branches 120 may be returned from the first position 200*a* to the second position 200*b* due to gravity or with a user's assistance. The stand 130 may be removed from the trunk 110 or folded as described above. The trunk 110 and the branches 120 may then be housed in the storage case 210 as shown in FIG. 5*c*.

It is understood that while certain forms of this invention have been illustrated and described, it is not limited thereto except insofar as such limitations are included in the following claims and allowable functional equivalents thereof.

What is claimed is as follows:

1. An artificial tree, comprising:

a tubular elongate trunk;

a plurality of branches, each branch having opposed first and second ends, each said second end having a hook and being positionable away from said trunk when said opposed first end is adjacent said trunk;

means for supporting said trunk in an upright position;

wherein:

said trunk presents an upper end and a lower end;

said trunk defines a plurality of openings between said trunk upper and lower ends;

each branch first end has an extension complementary to a respective trunk opening for selectively coupling said branch first end to said trunk;

each said trunk opening includes a primary opening and a flange opening;

each said extension includes a primary member, a flange having a diameter that is larger than a diameter of said primary member, and a plate having a diameter that is larger than said primary member diameter, said plate being spaced apart from said flange to define a receiving area therebetween;

each said primary member is receivable in a respective primary opening;

each said flange is receivable in a respective flange opening; and each said extension is rotatable when its primary member is received in a respective primary opening and its flange is received in a respective flange opening to sandwich said trunk between said flange and said plate of said extension, whereby coupling said extension to said trunk.

2. The artificial tree of claim 1, wherein:

said trunk presents an upper end and a lower end;

each said branch has a branch length; and said branch length increases with relative placement of said respective first ends along said trunk, whereby branches with greater branch lengths are closer to said trunk lower end than are branches with lesser branch lengths.

3. The artificial tree of claim 1, wherein:

said trunk presents an upper end and a lower end;

each said branch has a branch length; and every branch having a respective first end relatively closer to said trunk lower end has a branch length that is at least as long as every other branch having a respective first end relatively closer to said trunk upper end.

4. The artificial tree of claim 1, wherein said trunk defines an interior cavity having a diameter sufficient to house said branches when said first ends of said branches are not coupled to said trunk.

5. The artificial tree of claim 4, wherein:

said trunk interior cavity extends to said trunk upper end;

a cap is selectively coupled to said trunk at said trunk upper end to selectively restrict access to said trunk interior cavity; and a decorative element extends upwardly from said cap.

6. The artificial tree of claim 1, wherein:

said trunk presents an upper end and a lower end;

each said branch first end is hingedly coupled to said trunk between said trunk upper and lower ends so that the respective branch second end can rotate from a first position to a second position; and said second ends are relatively closer to said trunk upper end when at said second position than when at said first position.

7. The artificial tree of claim 6, further comprising a storage case for housing said trunk and said branches when said branch second ends are at said second position.

8. The artificial tree of claim 1, wherein each said branch has a branch length substantially equal to a branch length of every other said branch.

9. The artificial tree of claim 1, further comprising ornamentation supported by a plurality of said hooks at said second ends of said branches so that said ornamentation encircles said trunk.

10. The artificial tree of claim 9, wherein said ornamentation is selected from the group consisting of a garland and a lighting device.

11. The artificial tree of claim 1, further comprising an audio device in communication with a switch and a power source for selectively providing sound when said switch is activated.

12. The artificial tree of claim 1, further comprising an audio device in communication with a sensor, a processor, and a power source for selectively providing sound when said sensor detects a predetermined condition.

13. The artificial tree of claim 1, wherein said means for supporting said trunk in an upright position includes a stand presenting a diameter that is larger than a diameter of said trunk.

14. An artificial tree, comprising:

an elongate trunk presenting an upper end and a lower end;

a plurality of branches, each branch having opposed first and second ends, each said second end having a hook and being positionable away from said trunk when said opposed first end is adjacent said trunk;

a stand adjacent said trunk lower end to support said trunk in an upright position;

wherein:

said trunk defines a plurality of openings between said trunk upper and lower ends;

each branch first end has an extension complementary to a respective trunk opening for selectively coupling said branch first end to said trunk;

each said trunk opening includes a primary opening and a flange opening;

each said extension includes a primary member, a flange having a diameter that is larger than diameter of said primary member, and a plate having a diameter that is larger than said primary member diameter, said plate being spaced apart from said flange to define a receiving area therebetween;

each said primary member is receivable in a respective primary opening;

each said flange is receivable in a respective flange opening;

each said extension is rotatable when its primary member is received in a respective primary opening and its flange is received in a respective flange opening to sandwich said trunk between said flange and said plate of said extension, whereby coupling said extension to said trunk; and said trunk defines an interior cavity having a diameter sufficient to house said branches when said first ends of said branches are not coupled to said trunk.

15. The artificial tree of claim 14, further comprising:

ornamentation to be supported by a plurality of said hooks at said second ends of said brunches so that said ornamentation encircles said trunk when said branches are coupled to said trunk; and an audio device in communication with a power source and means for actuating said audio device for selectively providing sound.

16. The artificial tree of claim 14, wherein:

each said branch first end is hingedly coupled to said trunk between said trunk upper and lower ends so that the respective branch second end can rotate from a first position to a second position; and said second ends are relatively closer to said trunk upper end when at said second position than when at said first position.

17. The artificial tree of claim 16, further comprising:

ornamentation to be supported by a plurality of said hooks at said second ends of said branches so that said ornamentation encircles said trunk when said second ends of said branches are at said first position; and an audio device in communication with a power source and means for actuating said audio device for selectively providing sound.

* * * * *